US006326925B1

(12) United States Patent
Perkiö et al.

(10) Patent No.: US 6,326,925 B1
(45) Date of Patent: Dec. 4, 2001

(54) ANTENNA OF A RADIO DEVICE AND A METHOD TO MANUFACTURE IT AND A RADIO DEVICE

(75) Inventors: YrjöPerkiö; Pertti Puurunen, both of Oulu; Matti Niemi, Arkkukari; Petteri Annamaa, Oulu, all of (FI)

(73) Assignee: Filtronic LK Oy, Kempele (FI)

( * ) Notice: Subject to any disclaimer, the term of this patent is extended or adjusted under 35 U.S.C. 154(b) by 0 days.

(21) Appl. No.: 09/382,863

(22) Filed: Aug. 25, 1999

(30) Foreign Application Priority Data

Aug. 27, 1998 (FI) ..... 981835

(51) Int. Cl.[7] ..... H01Q 1/24
(52) U.S. Cl. ..... 343/702; 343/895; 343/872
(58) Field of Search ..... 343/702, 895, 343/906, 725, 729, 873, 872

(56) References Cited

U.S. PATENT DOCUMENTS

| | | | | |
|---|---|---|---|---|
| 5,341,149 | * | 8/1994 | Valimaa et al. | 343/895 |
| 5,745,523 | * | 4/1998 | Dent et al. | 375/216 |
| 5,828,342 | * | 10/1998 | Hayes et al. | 343/702 |
| 5,905,475 | * | 5/1999 | Annamaa | 343/895 |
| 5,945,964 | * | 8/1999 | DeGroot et al. | 343/895 |
| 6,018,326 | * | 1/2000 | Rudisill | 343/895 |
| 6,031,493 | * | 2/2000 | Tsuda et al. | 343/702 |
| 6,100,847 | * | 4/2000 | Sointula | 343/702 |
| 6,100,848 | * | 8/2000 | Hayes | 343/702 |

FOREIGN PATENT DOCUMENTS

| | | | |
|---|---|---|---|
| 0 831 549 | 3/1997 | (EP) | H01Q/11/08 |
| WO 97/42680 | 11/1997 | (WO) | H01Q/1/24 |
| WO 98/15028 | 4/1998 | (WO) | H01Q/1/36 |

* cited by examiner

*Primary Examiner*—Don Wong
*Assistant Examiner*—Ephrem Alemu
(74) *Attorney, Agent, or Firm*—Darby & Darby

(57) ABSTRACT

A radio device comprises an antenna for transmitting and receiving radio frequency signals. The antenna comprises a radiating antenna element (201, 602, 701) and a dielectric protective casing (202, 703) attached to each other, whereby the dielectric protective casing substantially encloses the antenna element. Further the radio device comprises a protective casing (205) of the radio device for mechanically supporting the radio device and for protecting its electrical components, and a printed circuit board (203) within the protective casing for connecting the electrical components to the radio device and for forming the electrical connections between the components. The antenna is mechanically fastened to the radio device with the aid of counterpart fastening shapes (301, 302, 303, 304, 305, 306, 307, 308) located in the antenna's protective casing and in the radio device's protective casing. The antenna is electrically connected to the radio device by a connection between a certain point (**201*b*, 201*b*') of the radiating antenna element and a certain point (204, 204', 402**) of the radio device.

21 Claims, 8 Drawing Sheets

FIG. 7
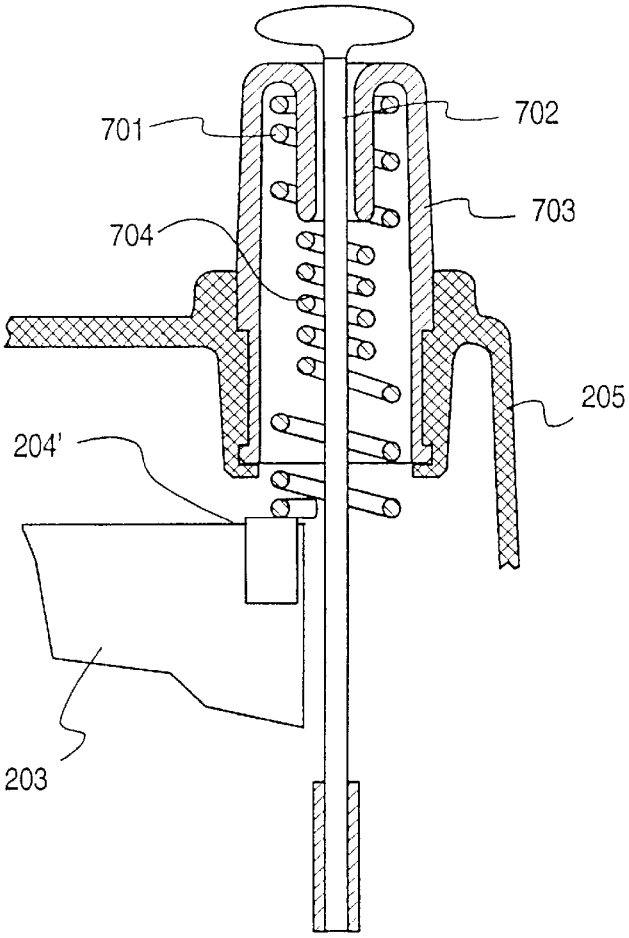
FIG. 8
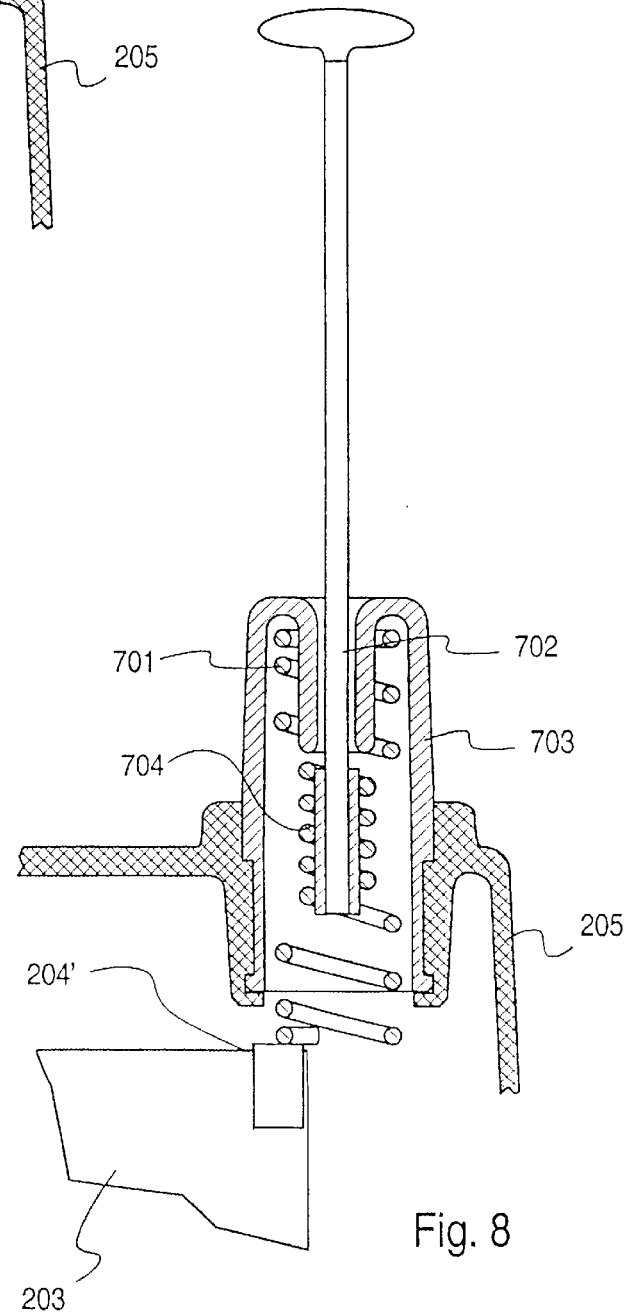
Fig. 8

ANTENNA OF A RADIO DEVICE AND A METHOD TO MANUFACTURE IT AND A RADIO DEVICE

The invention relates generally to the mechanical structures of antennas used in radio devices. Particularly the invention relates to an advantageous antenna structure to be attached to a small-sized radio device, and to a method for manufacturing it, as well as to a radio device provided with such an antenna.

Small-sized radio devices, such as mobile phones, must have a mechanical structure which is as simple as possible so that their manufacture in large-scale serial production will be fast and easy, and so that the structure will be mechanically robust. For the sake of simplicity it is advantageous that the structure has as few separate components as possible. On the other hand, it must be possible to dimension the antenna of the radio device very accurately so that it will operate effectively on the desired frequency band.

Figure 1:
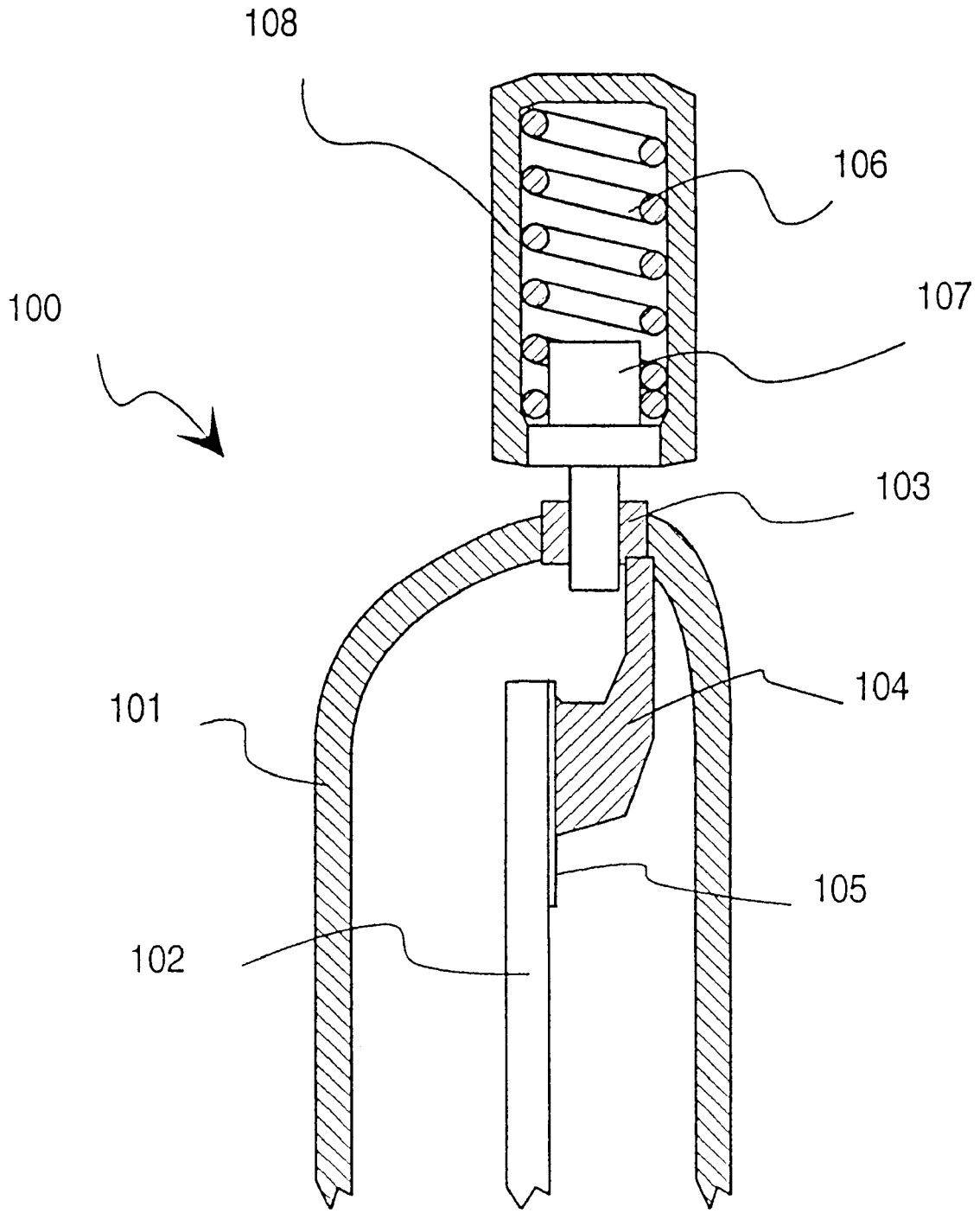
FIG. 1 PRIOR ART

Traditionally whip antennas and helix antennas and their combinations have been used as antennas of radio devices. FIG. 1 shows a partial section of a prior art mobile phone 100, where a printed circuit board 102 is within the protective casing 101. The casing is most often of injection moulded plastics and at one point of it there is an annular metal insert 103 having a threading on the inner surface. The metal insert is connected via a metallic conductor part 104 to the conducting connection area 105 on the surface of the printed circuit board, the area being usually called an RF pad. The antenna comprises the actual radiating antenna element, which in the structure of FIG. 1 is a helix element 106, and a metallic connector part 107, to which the helix element is fastened and which has a threading on the outer surface of the bottom part which fit into the threading of the metal insert 103. The radiating antenna element is protected by a hood 108 made of a dielectric material. In this patent application a radiating antenna element means that part of the antenna structure which is intended to transmit and receive electromagnetic radiation at a so called operating frequency.

The structure shown in FIG. 1 has relatively many separate parts. Further the received or transmitted signal has to pass via the interfaces of quite many components, which causes signal attenuation, reflection and other harmful effects.

The object of the invention is to present an antenna structure of a radio device with a simple construction. An object of the invention is also to present an antenna structure where there are only few interfaces in the signal path. A further object of the invention is to present an antenna structure of a radio device which is advantageous regarding the production techniques. A further object of the invention is to present a method to manufacture an antenna structure according to the invention and a radio device, which utilises the antenna structure according to the invention.

The objects of the invention are attained with an antenna structure, where the radiating antenna element is connected directly to the printed circuit board or to a desired point of a component on the printed circuit board, and where a dielectric protective casing acts as the mechanical connector of the antenna.

An antenna according to the invention is characterised in that in the protective casing of the antenna it comprises a fastening shape for fastening the antenna to a radio device.

A method according to the invention is characterised in that it comprises steps of forming a radiating antenna element, forming a dielectric protective casing and a fastening shape in the casing for the mechanical fastening of the antenna to the radio device, and fastening the radiating antenna element and the dielectric protective casing to each other so that the dielectric protective casing substantially encloses the radiating antenna element.

A radio device according to the invention is characterised in that the antenna is mechanically fastened to the radio device with the aid of counterpart fastening shapes located in the antenna's protective casing and in the radio device's protective casing, the antenna is electrically connected to the radio device by a connection between a certain point of the radiating antenna element and a certain point of the radio device.

In a structure according to the invention the dielectric protective casing of the antenna is directly connected to the protective casing of the radio device, whereby there is no need for a separate connector component or a metallic insert in the protective casing. Further, a suitable dimensioning of the structure enables a desired point of the radiating antenna element to be pressed against a connection area on the printed circuit board or against another desired point of the radio device, whereby there is no need for a separate conductor component within the protective casing of the radio device. Only one component interface is formed between the connection area and the radiating antenna element.

In one embodiment of the invention the radiating antenna element is a helix. It is enclosed by a dielectric protective casing which can be for instance plastics. The helix is fastened within the protective casing, either by heating, whereby the protective casing partly melts onto the outer surface of the metallic helix, or by a suitable filler which acts as an adhesive between the helix and the protective casing.

A protective casing of a radio device means here very generally any part of the radio device which substantially encloses the electrical components of the radio device, at least in that part of the radio device where the antenna is fastened.

In another preferred embodiment of the invention there are two radiating antenna elements, of which the first one is a helix and the second one is a whip. The whip can further be movable relating the rest of the structure, whereby in a certain first extreme position it is mainly pushed within the protective casing of the radio device, and in a certain second extreme position it is mainly pulled outside the protective casing of the radio device.

The invention does not restrict the number, the form nor the mutual positioning of the radiating antenna elements. Thanks to the invention, in the simplest case the antenna and the structure fastening it to the radio device comprise only two parts, whereby the structure is very advantageous regarding the production techniques, and it is easy to make it mechanically very strong. A simple radiating element and the location of its connection point in the radio device can be easily dimensioned so that the antenna operates on the desired frequency band.

Figure 2:
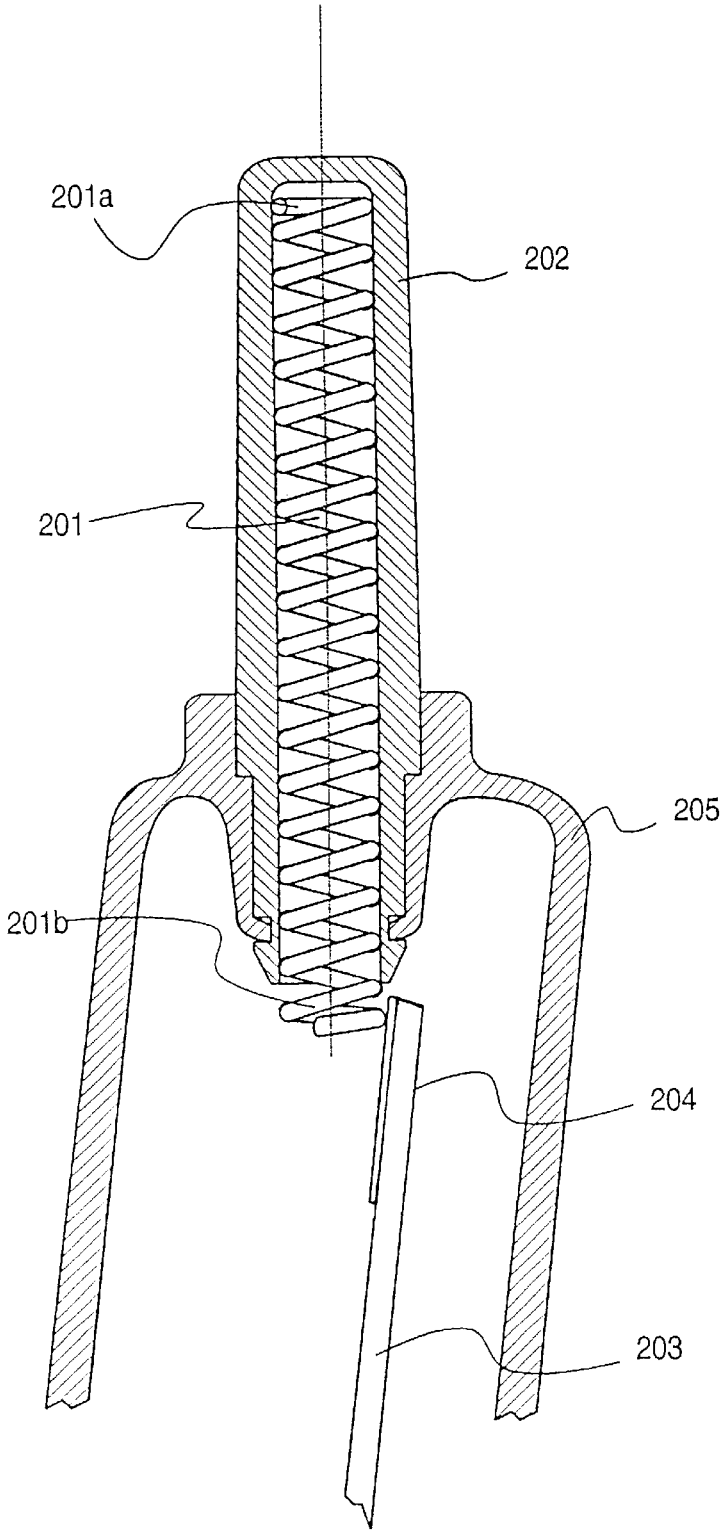
Figure 3:
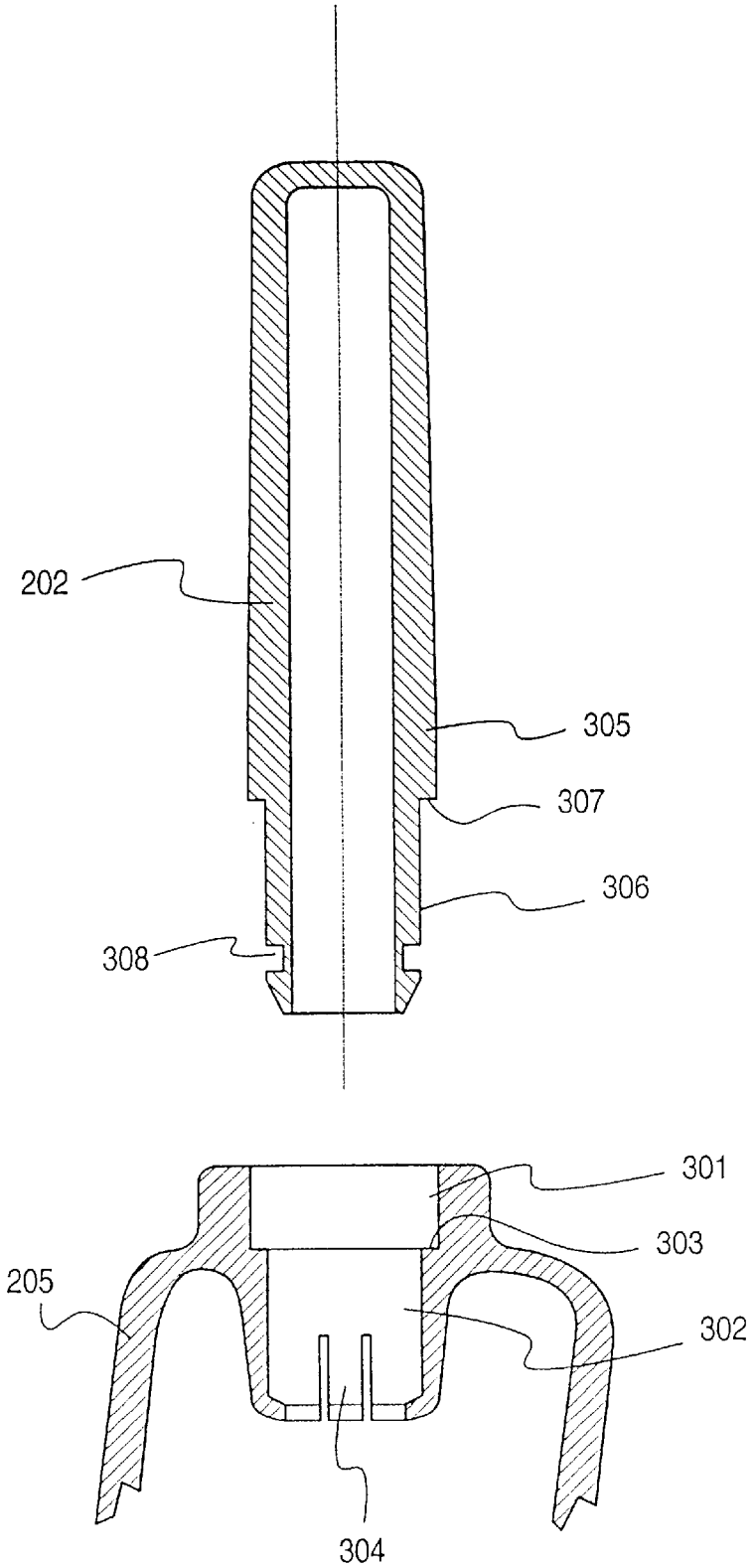
Figure 4:
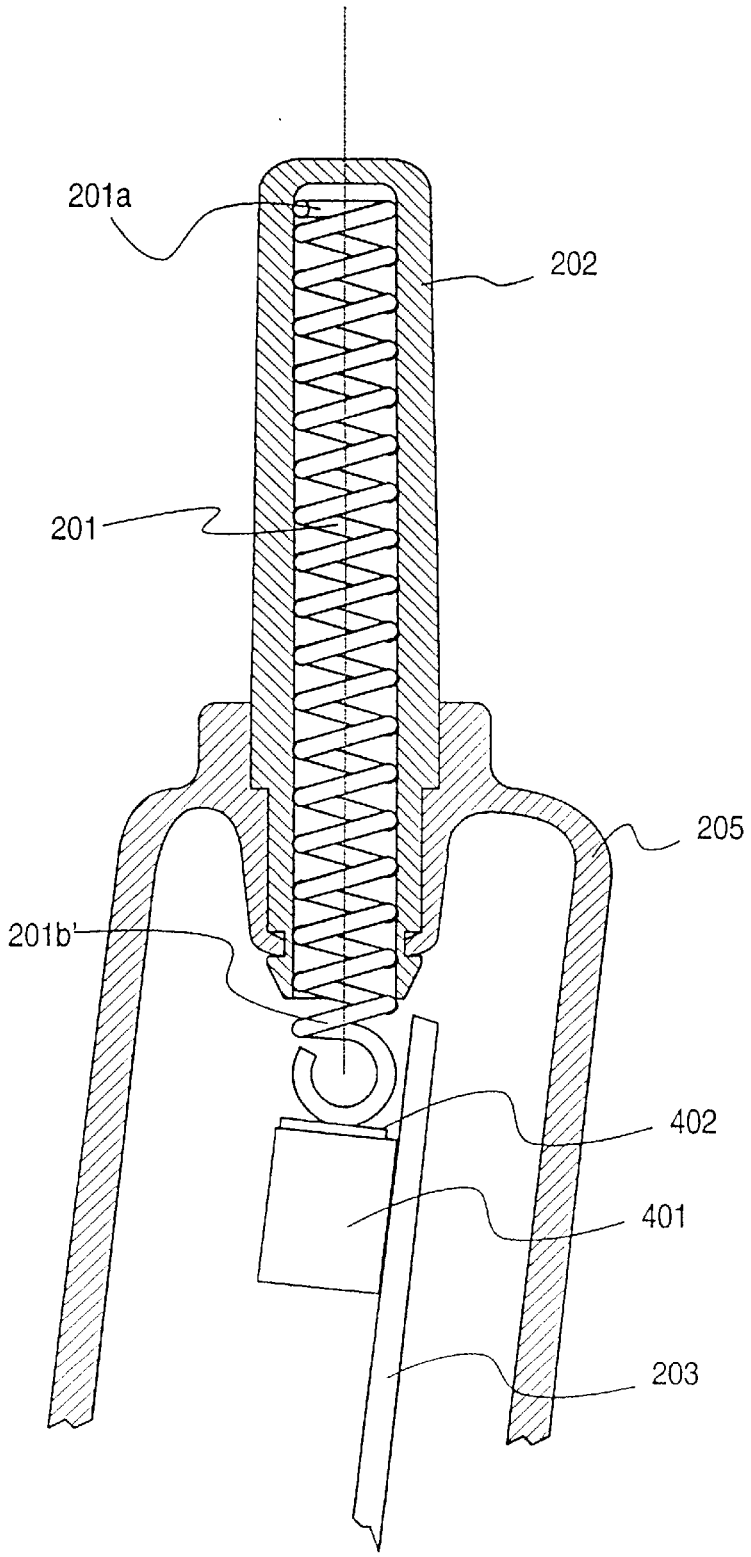
Figure 5:
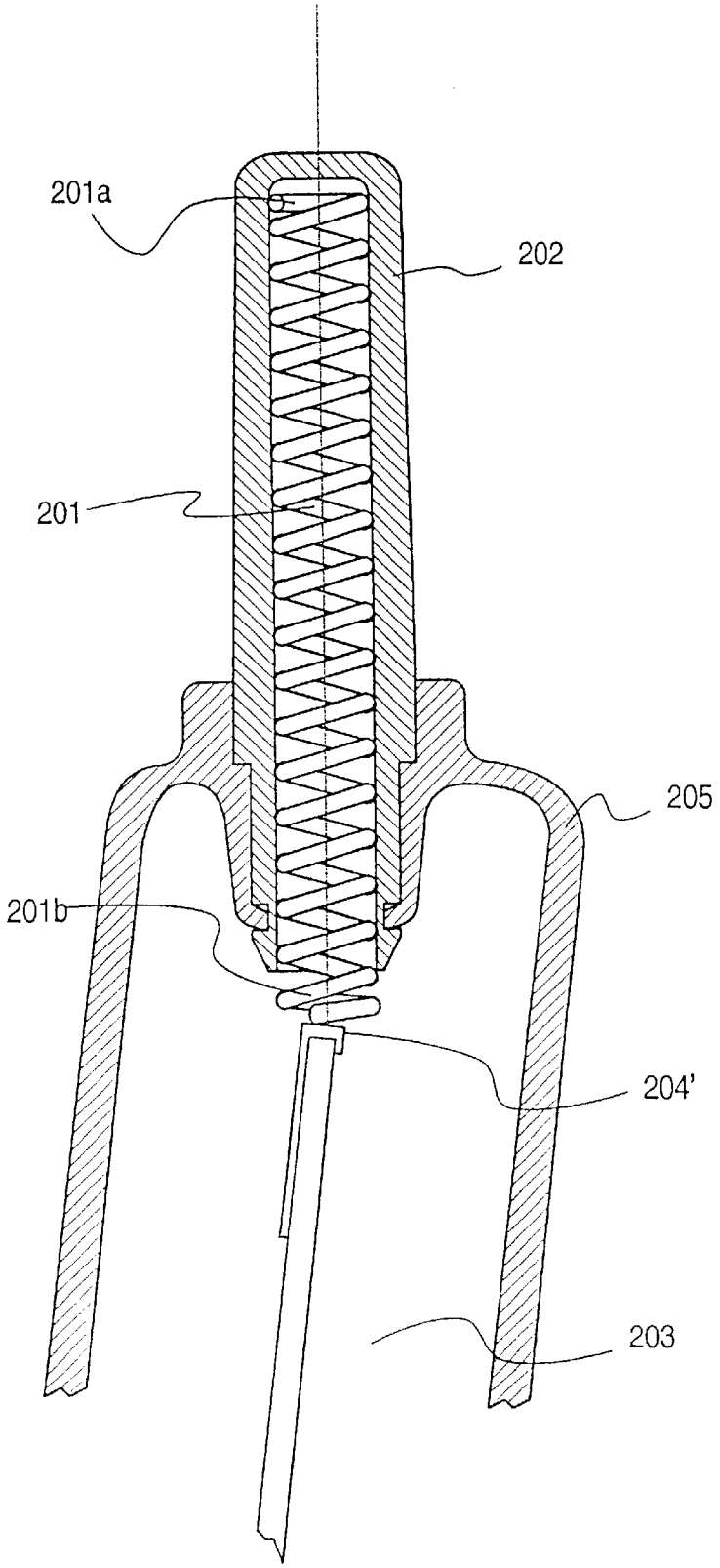
Figure 6:
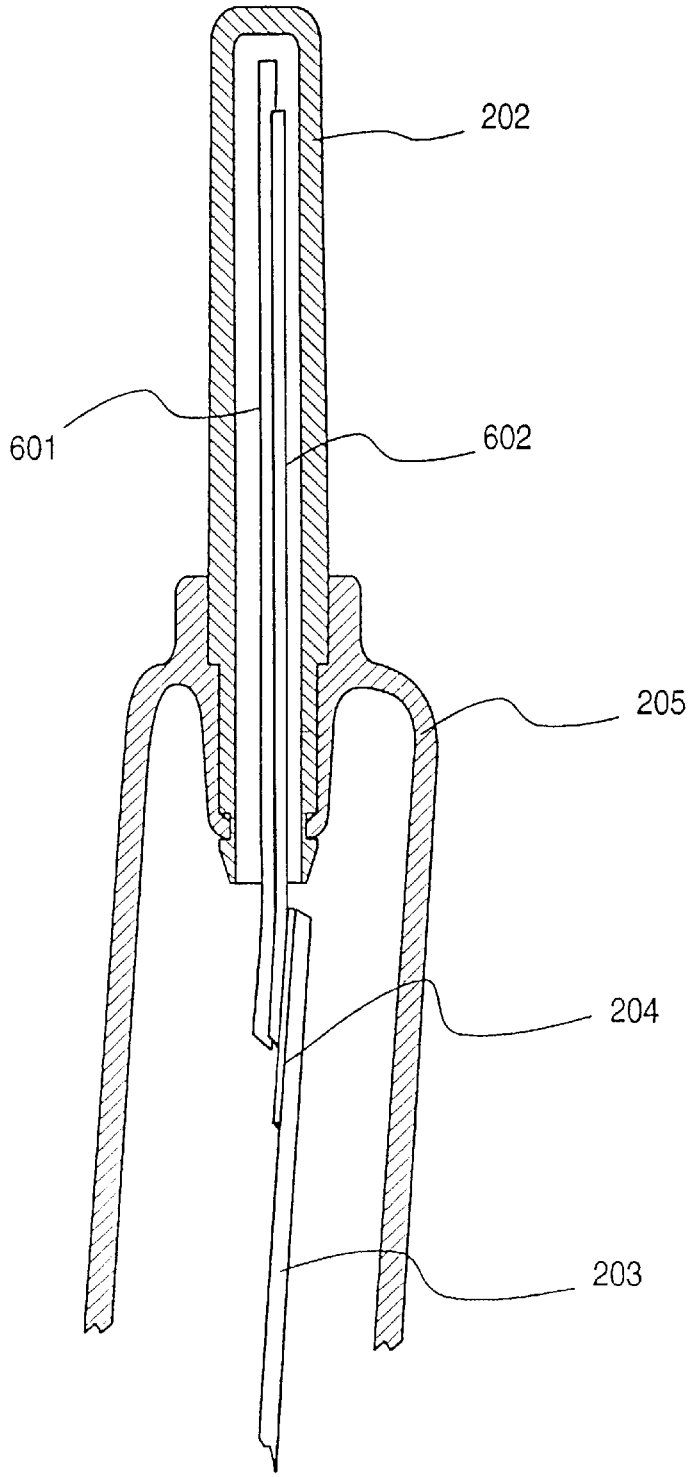
Figure 9:
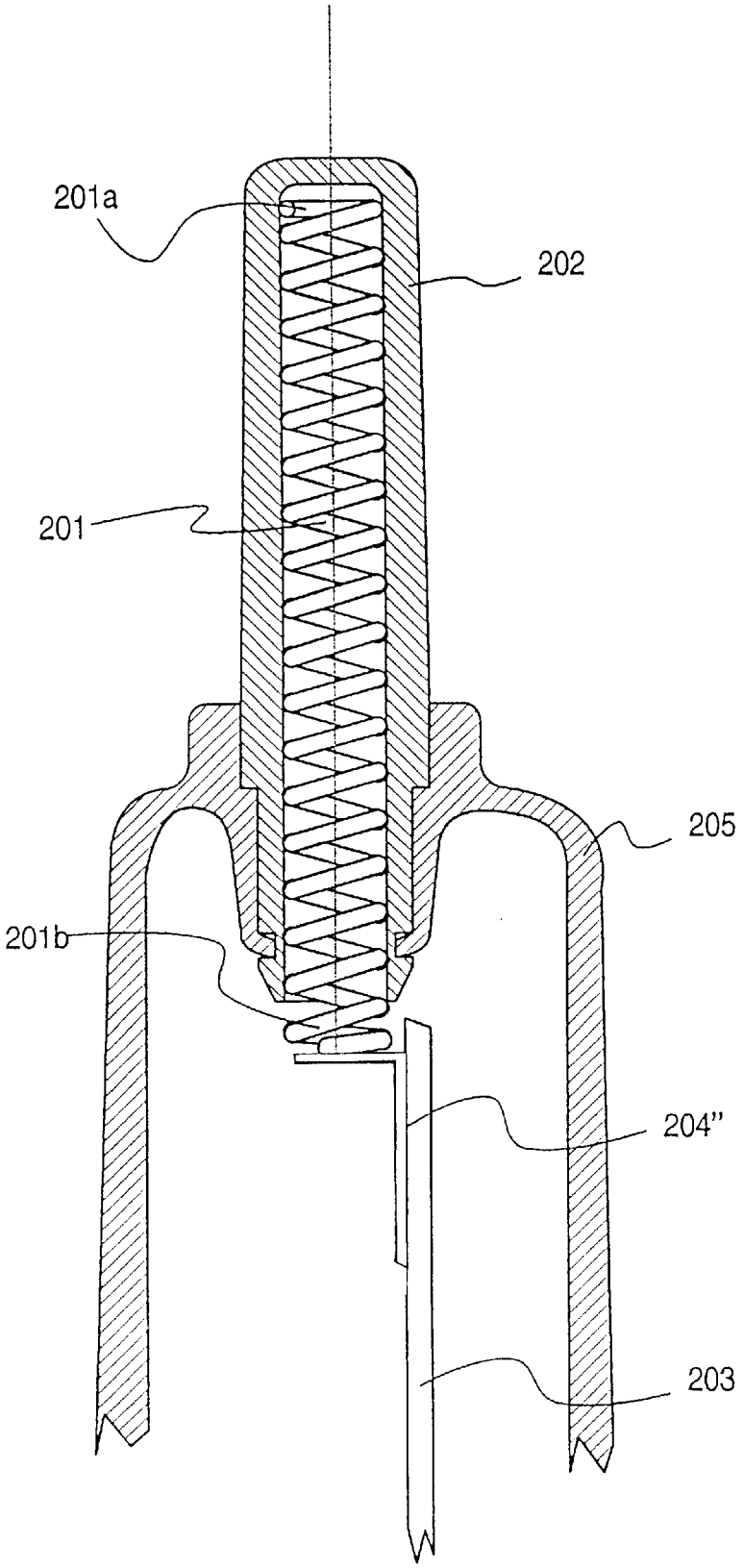

The invention is described in more detail below with reference to the preferred embodiments presented as examples and with reference to the enclosed figures, in which FIG. 1 shows a prior art antenna structure, FIG. 2 shows an antenna structure according to a preferred embodiment of the invention, FIG. 3 shows a detail of the structure according to FIG. 2, FIG. 4 shows a modification of the structure according to FIG. 2, FIG. 5 shows another modification of the structure according to FIG. 2, FIG. 6 shows a third modification of the structure according to FIG. 2, FIG. 7 shows an antenna structure according to a second preferred embodiment of the invention in its first position, and FIG. 8 shows the structure according to FIG. 7 in a second position, and FIG. 9 shows a modified version of the antenna structure of FIG. 2.

Above we referred to FIG. 1 in connection with the description of prior art, so in the following description of the invention and its advantageous embodiments we refer mainly to the FIGS. 2 to 8. Corresponding reference numerals are used for corresponding parts.

In the antenna structure of FIG. 2 the radiating antenna element is a conductor wound to a cylindrical coil, or a helix 201. In the direction of its longitudinal axis it has a first end 201*a* and a second end 201*b*. The first end is covered by a hood-like protective casing 202, which is made of a dielectric material and which in the direction of the longitudinal axis extends almost to the second end of the helix. In the example of the figure the second end projects about 1⅓ turns outside the protective casing. Regarding the invention it is not important as such how far the protective casing extends towards the second end of the helix. However, one task of the protective casing is to mechanically support the helix, so that regarding the stability of the structure it is advantageous that it encloses the helix as fully as possible, but so that between the second end 201 b of the helix and the connection area in the radio device it is possible to obtain a connection in the manner described below.

Regarding the manufacturing techniques and the stability of the structure it is advantageous to make a mutual fixing between the radiating antenna element and the dielectric protective casing enclosing it. In the embodiment of FIG. 2 the helix 201 can be fastened inside the protective casing 202 in many ways. One alternative in connection with the manufacturing is to heat the helix over the melting point of the protective casing, for instance using induction heating, whereby the helix will melt a part of the material of the protective casing which touches the helix, and a melting joint is formed between the parts. Another possibility is to partly fill the inside of the entity formed by the helix 201 and the protective casing 202 with a dielectric filler, which acts like an adhesive and joins the parts together. A suitable filler is for instance silicon, polyurethane, or a hot-setting adhesive. A third possibility is that the protective casing is made by moulding, by injection moulding or by any other method based on solidification of a liquid material, whereby during manufacture the helix is placed within the mould, so that the solidifying material of the protective casing is attached to the helix. A further simple possibility is to make the inner diameter of the protective casing so narrow that, when the helix is pushed into the protective casing, the friction between the helix and the protective casing material is sufficient to keep the parts in mutual contact. However, during the attachment it is necessary to ensure that the pitch and other design factors of the helix will not unintentionally change, because such design factors affect the electrical operation of the helix as an antenna.

FIG. 2 shows the printed circuit board 203 of the radio device and the connection area on its surface, i.e. the RF pad 204. In the radio device a lot of components, for the sake of clarity not shown in the FIG. 2, are fastened to the printed circuit board. One component of the radio device being in a direct electrical contact to the electrically conducting connection area 204 is usually the duplex filter or the antenna switch. The last turn of the second end 201*b* of the helix 201 contacts the connection area 204, whereby there is formed an electrically conducting connection between the radiating antenna element and that component being in contact with the connection area 204.

FIG. 2 shows also the protective casing 205 of the radio device, whereby the casing has certain fastening shapes. With the aid of these and corresponding shapes in the antenna protective casing 202 the entity comprising the antenna protective casing and the radiating antenna element and possible the filler material joining them is mechanically fastened to the radio device. The details of the fastening shapes are not relevant regarding the invention. FIG. 3 shows in more detail that exemplary alternative of the attachment design, which is used in the structure according to FIG. 2. The protective casing 205 of the radio device has a cylindrical bore, having a wider section 301 at the outer end and a narrower section 302 at the inner end. The sections are separated by a step 303. At the inner end of the narrower section there are tongues 304 directed inwards to the protective casing of the radio device, whereby each tongue at the end pointing inwards to the radio device has a tooth directed towards the central axis of the cylindrical bore. The protective casing 202 of the antenna has a wider section 305 and a narrower section 306, having diameters corresponding to the diameters of the wider section 301 and the narrower section 302 in the radio device's protective casing, and being separated by a step 307. Further the narrower section 306 of the antenna's protective casing has a groove 308 encircling the narrower section. When the protective casing 202 of the antenna is pressed into the bore of the protective casing 205 of the radio device as far as possible, then the teeth of the tongues 304 snap into the groove 308. At the same time the steps 303 and 307 abut each other and stabilise the structure. An attachment where a certain flexible part locks into a corresponding groove or recess is generally called a snap-attachment.

The connection between the protective casing of the antenna and the protective casing of the radio device can also be realised by a threading, by another type of a snap-attachment, or by any means known per se to a person skilled in the art, so that when required, the antenna can be detached from the radio device, for instance in order to replace a defective antenna.

The dimensions of the radiating antenna element, the protective casing of the antenna, the protective casing of the radio device, and of the above described fastening shapes must be chosen so that the radiating antenna element will make a desired connection to the other parts of the radio device when the antenna is fastened to the radio device. If the radiating antenna element is elastic this characteristic can be advantageously utilised for realising the connection between it and the desired point of the radio device. In FIG. 2 the helix 201 is most preferably made of phosphor bronze, of nickel-plated spring-steel wire, or of any other manufacturing material for helix antennas known per se, whereby it mechanically operates as a helical spring. The mutual dimensions of the components are then most preferably chosen so that when the antenna is fastened in its place in the way according to FIG. 2 the bottom end 201*b* of the helix is subject to a slight elastic deformation. Then the spring force caused by the elasticity of the helix material presses the bottom end 201*b* of the helix firmly against the connection area 204. In order to make the dimensioning easier and to provide a good elastic deformation the antenna is advantageously fastened to the radio device so that its longitudinal axis is not in the same direction as the surface of the printed circuit board, but that there is an angle of 5 to 10 degrees between them.

The use of a nickel-plated spring steel wire as the helix material presents also an advantage in that it forms a good electrochemical pair with gold or palladium. The last mentioned materials are often used as plating of the connection areas on printed circuit boards.

The protective casing of the antenna is most preferably made by injection moulding or by moulding of a suitable plastics, such as polypropylene, polyethylene, or another plastic material known per se.

FIG. 4 shows a modification of the structure according to FIG. 2. A helix 201 acts as the radiating antenna element in the same way as in FIG. 2, but at its second end 201*b*' the last turn of the helix is twisted about 90 degrees around an axis, which is perpendicular to the longitudinal axis of the helix. Another change shown in FIG. 4 as compared to the structure of FIG. 2 is that the radiating antenna element is not connected to the printed circuit board 203 of the radio device but to a connection area 402 on the surface of the duplex filter 401. With a solution of this kind it is possible to shorten the path of the signal between the antenna and the duplex filter, which decreases losses, and which in certain circumstances can prevent the generation of certain signal components on interfering frequencies. Instead of the duplex filter the radiating antenna element can also be connected to another component of the radio device, such as to an antenna switch, an amplifier, to another filter than the duplex filter, and so on.

FIG. 5 shows another modification of the structure according to FIG. 2. The structure is in other respects similar to that of FIG. 2, but that point of the connection area 204', to which the radiating antenna element is connected, is not on the flat surface of the printed circuit board 203 but at its end. In a solution of this kind the dimensioning of the antenna fastening can be easier than in the solution according to FIG. 2. It is not necessary that the printed circuit board is in an oblique angle regarding the longitudinal axis of the antenna.

FIG. 6 shows a third modification of the solution according to FIG. 2. In this case the radiating antenna element is not a helix comprising a conductor wound to a cylindrical coil, but a conductor pattern 602 formed on the surface of a low-loss piece of printed circuit board 601. The low-loss printed circuit board is in FIG. 6 assumed to be flexible, whereby the electrical connection between the lower end of the conductor pattern 602 and the connection area 204 on the printed circuit board 203 of the radio device is secured by dimensioning the structure so that when the antenna is attached the piece of printed circuit board 601 is slightly bent at its lower end. The spring force caused by the elastic deformation presses the lower part of the conductor pattern 602 tightly against the connection area 204. The invention does not limit the shape of the conductor pattern 602. It can comprise straight sections, meander-like sections, and other forms known as such in the field of planar antennas.

As such the invention does not require that there is a galvanic connection between the radiating antenna element and the printed circuit board of the radio device or a component mounted on the printed circuit board, even though a minimal attenuation and other advantageous features are obtained with a galvanic connection. The radiating antenna element can also be completely enclosed within a dielectric protective casing, whereby there is a capacitive coupling between its bottom end and the connection area on the surface of the printed circuit board of the radio device or some other suitable point of the radio device. The conductor pattern acting as the radiating antenna element in the structure of FIG. 6 can be formed on that side of the piece of low-loss printed circuit board 601 which in the final structure is not pressed against the printed circuit board of the radio device, whereby a capacitive coupling between the radiating antenna element and the connection area of the printed circuit board of the radio device is effected through the piece of low-loss printed circuit board.

The radiating antenna element can also be another antenna element known per se. Further the structure according to the invention can be realised so that it comprises several radiating antenna elements. The FIGS. 7 and 8 present a simplified longitudinal section of a combined antenna with a helix element 701 and a whip element 702. The helix element is mainly located inside the dielectric protective casing 703, but its lower end is partly uncovered and is pressed against the connection area 204' on the printed circuit board 203 of the radio device. The bottom part of the helix element has a tighter wound section 704 which transmits the connection between the helix element and the whip element when the whip element is in the position according to FIG. 8. The protective casing 703 of the antenna is mechanically connected to the protective casing 205 of the radio device in the same way as described above. Centrally in the protective casing of the antenna there is a bore in the direction of its longitudinal axis, in which the whip antenna can be moved between first and second extreme positions. In FIG. 7 the whip element is in the first extreme position and in FIG. 8 it is in the second extreme position. In FIG. 8 a bulge at the bottom end of the whip element shorts the tighter wound section 704 of the helix element.

FIG. 9 shows a modification made from the structure of FIG. 2 where the antenna 201 and the printed circuit board 203 are parallel and where the abutting point on the printed circuit board for the bottom end 201*b* of the antenna is a projecting connection area 204", which can be for instance a piece of metal bent into the form of an angle and fastened to the printed circuit board. The antenna attachment is dimensioned in relation to the printed circuit board so that when the antenna is attached the lower end of the helix wire abuts the connection area, whereby an elastic deformation in either of them or in both generates a spring force which presses the lower end of the helix wire and the connection area against each other. The advantage of this embodiment is a great freedom presented to the designer in choosing the location of the antenna in the radio device.

Features of the above presented embodiments can be combined without leaving the scope which is defined in the claims presented below. For instance, a joint according to FIG. 5 which is based on deformation in the direction of the longitudinal axis of the antenna can be realised also between the radiating antenna element and the duplex filter or some other component. Above we discussed mainly a so called duplex antenna, which is intended both for transmission and reception. This antenna type is the by far the most common in mobile phones. However, the invention places no limitations on whether the antenna is used only for transmission, only for reception, or for both purposes.

In the method according to the invention the radiating antenna element is manufactured and attached to a dielectric protective casing, either in connection with the manufacturing of the dielectric protective casing, or afterwards. In the latter case a dielectric filler or heating of the radiating antenna element can be used as an aid. In connection with the manufacturing of the dielectric protective casing there is formed a fastening shape for attaching it to the protective casing of a radio device. As the last manufacturing step the entity formed by the radiating antenna element and the dielectric protective casing is attached to a radio device so that the dielectric protective casing of the antenna is fastened mechanically to the protective casing of the radio device. This last manufacturing step is typically made separately from the previous steps, because the antenna manufacturer generally produces the entity formed by the radiating antenna element and the dielectric protective casing in his own factory and delivers it to the radio device assembly factory in order to attach it to a radio device.

The invention is applicable particularly in small-sized portable radio devices having operating frequencies lying in the area of hundreds of megahertz or a few gigahertz. The invention is particularly well suited to be used in mobile phones.

What is claimed is:

1. An antenna of a radio device comprising a radiating element and a dielectric protective casing enclosing substantially said radiating element, characterized in that said protective casing comprises a shape for fastening the antenna to the radio device, and said radiating element is attached to said protective casing, extends outside said protective casing and is arranged to be connected directly to one of a circuit board and a component directly connected to a printed circuit board of the radio device.

2. An antenna according to claim 1, characterized in that said shape for fastening is a threading.

3. An antenna according to claim 1, characterized in that said shape for fastening comprises a groove for receiving such a counterpart shape in the radio device which is arranged to be locked into said groove when the antenna is attached to the radio device.

4. An antenna according to claim 1, characterized in that the radiating element is a helix.

5. An antenna according to claim 1, characterized in that the radiating element is a conductor pattern formed on the surface of a dielectric board, whereby the radiating element is attached to the dielectric protective casing via said dielectric board.

6. An antenna according to claim 1, characterized in that it comprises a first radiating antenna element and a second radiating antenna element, of which the first radiating antenna element is a helix and the second radiating element is a straight conductor, which in the direction of its longitudinal axis can be moved in relation to the dielectric protective casing and the first antenna element between first and second extreme positions.

7. A method to manufacture an antenna of a radio device, characterized in that it comprises steps of:

forming a radiating antenna element, forming a dielectric protective casing and a fastening shape in the casing for the mechanical fastening of the antenna to the radio device, fastening the radiating antenna element and the dielectric protective casing to each other using a predetermined process so that the dielectric protective casing substantially encloses the radiating antenna and the end of the radiating element extends outside the protective casing, and connecting the end of the radiating antenna element directly to one of a printed circuit board and a component directly connected to a printed circuit of the radio device.

8. A method according to claim 7, characterized in that the radiating antenna element and the dielectric protective casing are fastened to each other by a melting joint.

9. A method according to claim 7, characterized in that the radiating antenna element and the dielectric protective casing are fastened to each other with the aid of a dielectric filler, which fills a certain part of the internal volume of the dielectric protective casing.

10. A method according to claim 7, characterized further in that the antenna comprising the dielectric protective casing and the radiating antenna element is fastened to the radio device so that the mechanical fastening between the antenna and the radio device is made with the aid of fastening shapes within the dielectric protective casing and the covering of the radio device, and that the electrical connection between the antenna and the radio device is made by pressing a certain point of the radiating antenna element against a connection area in the radio device.

11. The method of claim 7, wherein said predetermined process includes the steps of heating the radiating antenna element over the melting point of the dielectric protective casing to form a melting joint between the element and the casing.

12. The method of claim 7, wherein said predetermined process includes the step of:

manufacturing a said protective casing by a solidification of a liquid material; and placing the radiating antenna element in the dielectric casing during manufacturing of the casing; whereby upon solidifying, said protective casing is attached to said radiating antenna element.

13. The method of claim 7, wherein said predetermined process includes the step of using a dielectric filler to adhesively join the radiating element and the dielectric casing.

14. The method of claim 13, wherein said filler is one of silicon, polyurethane and a hot-setting adhesive.

15. A radio device, which comprises an antenna having a dielectric protective casing enclosing substantially a radiating element, and said radiating element having an end extending outside the protective casing, a covering of the radio device for mechanically supporting the radio device and for protecting its electrical components, and a printed circuit board within the covering of the radio device for connecting the electrical components to the radio device and for forming the electrical connections between the components, characterized in that the radiating element is attached to said protective casing, the antenna is mechanically fastened to the radio device with the aid of counterpart fastening shapes located in the antenna's protective casing and in the radio device's covering, and the antenna is electrically connected to the radio device by a direct connection between a certain point of the end radiating antenna element and a certain point of one of a printed circuit board and a certain component directly connected to a printed circuit board of the radio device.

16. A radio device according to claim 15, characterized in that the antenna is electrically connected to the radio device so that a certain point of the radiating antenna element abuts a certain connection area (204, 204') on the printed circuit board of the radio device.

17. A radio device according to claim 15, characterized in that in order to form the connection between a certain point of the radiating antenna element and a certain point of the radio device the radiating antenna element comprises an elastic deformation causing a spring force which presses the certain point of the antenna element against the certain point of the radio device.

18. A radio device according to claim 17, characterized in that said certain point of the radio device is a connection area on the flat surface of the printed circuit board, and that in order to form said elastic deformation the longitudinal axis of the antenna forms an angle different from zero regarding the direction of the surface of the printed circuit board.

19. A radio device according to claim 15, characterized in that the antenna is electrically connected to the radio device so that a certain point of the radiating antenna element abuts a certain connection area (402) on said component which is fastened to the printed circuit board (203) of the radio device.

20. A radio device according to claim 19, characterized in that said component is a duplex filter.

21. A radio device according to claim 19, characterized in that said component is an electrically conducting body fastened to the printed circuit board.

* * * * *